US007058331B2

(12) United States Patent
Ota

(10) Patent No.: US 7,058,331 B2
(45) Date of Patent: Jun. 6, 2006

(54) FIXING APPARATUS AND IMAGE FORMING APPARATUS

(75) Inventor: Hiroshi Ota, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 55 days.

(21) Appl. No.: 10/835,558

(22) Filed: Apr. 30, 2004

(65) Prior Publication Data

US 2005/0244182 A1 Nov. 3, 2005

(51) Int. Cl.
*G03G 15/20* (2006.01)

(52) U.S. Cl. ..... 399/70

(58) Field of Classification Search ..... 399/70, 399/328

See application file for complete search history.

(56) References Cited

U.S. PATENT DOCUMENTS 6,615,003 B1 9/2003 Nakayama
6,763,206 B1 * 7/2004 Kinouchi et al. ..... 399/70
2003/0235423 A1 12/2003 Ota
2004/0126127 A1 * 7/2004 Fujimori et al. ..... 399/70

FOREIGN PATENT DOCUMENTS

JP 2003-215954 A 7/2003

* cited by examiner

*Primary Examiner*—Quana Grainger
(74) *Attorney, Agent, or Firm*—Foley & Lardner LLP

(57) ABSTRACT

An warming-up operation is performed by driving the first coil and the second coil in accordance in an operating mode already stored, until the temperatures T1 and T2 detected by the first and second temperature sensors, respectively, reach preset value Ts. A temperature rise ΔT1 per unit time of the temperature T1 detected by the first temperature sensor during the warming-up operation is determined. Also, temperature rise ΔT2 per unit time of the temperature T2 detected by the second temperature sensor during the warming-up operation is determined. The operating mode is updated to such an operating mode that the temperature rises ΔT1 and ΔT2 determined by the second control section become equal to each other.

18 Claims, 6 Drawing Sheets

| Operating mode | Period of driving the center coil (sec) | Period of driving the side coil (sec) |
|---|---|---|
| 12 | 1.5 | 1 |
| 13 | 1.4 | 1 |
| 14 | 1.3 | 1 |
| 15 | 1.2 | 1 |
| 16 | 1.1 | 1 |
| 17 | 1 | 1 |
| 18 | 1 | 1.1 |
| 19 | 1 | 1.2 |
| 20 | 1 | 1.3 |
| 21 | 1 | 1.4 |
| 22 | 1 | 1.5 |

| Operating mode | Period of driving the center coil (sec) | Period of driving the side coil (sec) |
|---|---|---|
| 12 | 1.5 | 0.5 |
| 13 | 1.4 | 0.6 |
| 14 | 1.3 | 0.7 |
| 15 | 1.2 | 0.8 |
| 16 | 1.1 | 0.9 |
| 17 | 1 | 1 |
| 18 | 0.9 | 1.1 |
| 19 | 0.8 | 1.2 |
| 20 | 0.7 | 1.3 |
| 21 | 0.6 | 1.4 |
| 22 | 0.5 | 1.5 |

FIG. 10

| Operating mode | Period of driving the center coil (W) | Period of driving the side coil (W) |
|---|---|---|
| 1 | 1200 | 1000 |
| 2 | 1180 | 1000 |
| 3 | 1160 | 1000 |
| 4 | 1140 | 1000 |
| 5 | 1120 | 1000 |
| 6 | 1100 | 1000 |
| 7 | 1080 | 1000 |
| 8 | 1060 | 1000 |
| 9 | 1040 | 1000 |
| 10 | 1020 | 1000 |
| 11 | 1000 | 1000 |
| 12 | 1000 | 1020 |
| 13 | 1000 | 1040 |
| 14 | 1000 | 1060 |
| 15 | 1000 | 1080 |
| 16 | 1000 | 1100 |
| 17 | 1000 | 1120 |
| 18 | 1000 | 1140 |
| 19 | 1000 | 1160 |
| 20 | 1000 | 1180 |
| 21 | 1000 | 1200 |

FIG. 11

| Operating mode | Period of driving the center coil (W) | Period of driving the side coil (W) |
|---|---|---|
| 1 | 800 | 1200 |
| 2 | 820 | 1180 |
| 3 | 840 | 1160 |
| 4 | 860 | 1140 |
| 5 | 880 | 1120 |
| 6 | 900 | 1100 |
| 7 | 920 | 1080 |
| 8 | 940 | 1060 |
| 9 | 960 | 1040 |
| 10 | 980 | 1020 |
| 11 | 1000 | 1000 |
| 12 | 1020 | 800 |
| 13 | 1040 | 820 |
| 14 | 1060 | 840 |
| 15 | 1080 | 860 |
| 16 | 1100 | 880 |
| 17 | 1120 | 900 |
| 18 | 1140 | 920 |
| 19 | 1160 | 940 |
| 20 | 1180 | 960 |
| 21 | 1200 | 980 |

FIXING APPARATUS AND IMAGE FORMING APPARATUS

BACKGROUND OF THE INVENTION

This invention relates to an image forming apparatus that reads an image from an original document and forms a developer image corresponding to the image read, on a paper sheet. The fixing apparatus provided in the image forming apparatus fixes the developer image formed on the paper sheet.

The fixing apparatus described above takes the paper sheet in the nip between a heat roller and a press roller and applies heat and pressure to the paper sheet, thereby fixing the developer image on the paper sheet. A center coil and side coils, each designed to perform induction heating, are provided on the inner surface of the heat roller or close to the outer surface thereof. A high-frequency current is supplied to these coils, which generate a high-frequency magnetic field. The magnetic field generates an eddy current in the heat roller. The eddy current brings forth Joule heat. The Joule heat heats the heat roller.

The center coil performs induction heating, heating a part of the heat roller, which is substantially middle in the axial direction of the heat roller. One of the side coils heats one end part of the heat roller. The other side coil heats the other end part of the heat roller. The center coil, on the one hand, and the side coils are driven, on the other, are alternately driven, each for a controlled time, so that the temperature T1 of the center part of the heat roller and the temperature T2 of the end parts thereof may have a preset value Ts, no matter whether a paper sheet exists or whatever size a paper sheet, if any, has (A4-R size, A3 size or the like). Alternatively, the center coil and the side coils may be driven at the same time to have their outputs controlled.

In a warming-up operation period immediately after the power switch of the image forming apparatus is closed, the center coil and the side coils are so driven that the temperatures T1 and T2 may quickly rise to the preset value Ts. The temperatures T1 and T2 rises at different rates, however, due to the difference between the heat capacity of the fixing apparatus and the design heat capacity that the fixing apparatus should have or due to the environmental changes that influence the fixing apparatus. For example, the temperature T2 of one end part of the heat roller rises to the preset value Ts some time after the temperature T1 of the middle part of the heat roller reached the preset value Ts. In this case, the warming-up operation is terminated when the temperature T2 reaches the preset value Ts. Consequently, the warming-up operation period becomes longer than is desired. Further, the heat emanating from the center coil for the time that is the difference between the desired warming-up operation period and the actual warming-up operation period is inevitably wasted.

BRIEF SUMMARY OF THE INVENTION

An object of the present invention is to provide a fixing apparatus and an image forming apparatus, in which the time for warming up the heat roller can be shorted and the heat wasted during the warming-up operation period can be decreased.

A fixing apparatus according to this invention comprises:

a heating member which rotates;

a first coil which is configured to perform induction heating on a middle of the heating member;

a second coil which is configured to perform induction heating on an end of the heating member;

a first temperature sensor located at the middle of the heating member;

a second temperature sensor located at the heating member;

a first control section which performs a warming-up operation by driving the first coil and the second coil;

a second control section which determines a temperature rise rate per unit time of the temperature detected by the first temperature sensor during the warming-up operation and also a temperature rise rate per unit time of the temperature detected by the second temperature sensor during the warming-up operation; and a third control section which controls the temperature rise rates to become equal to each other.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

FIG. 10 is a table showing various modes in which the coils are driven in a third embodiment of the invention;

FIG. 11 is a table showing various modes in which the coils are driven in a fourth embodiment of the present invention.

DETAILED DESCRIPTION OF THE INVENTION

[1] The first embodiment of this invention will be described, with reference to some of the accompanying drawings.

An image forming apparatus according to the first embodiment of the invention comprises a scanning unit (i.e., scanning unit 33 described later), a processing unit (i.e., processing unit 45 later described), and a fixing apparatus (i.e., fixing apparatus 1 described later). The scanning unit optically reads the image printed on an original document. The processing unit forms, on a paper sheet, a developer image corresponding to the image read by the scanning unit. The fixing apparatus heats the paper sheet, thereby fixing the developer image on the paper sheet. The image forming apparatus is configured as is disclosed in patent application Ser. No. 09/955,089, and its configuration will not be described herein.

Figure 1:
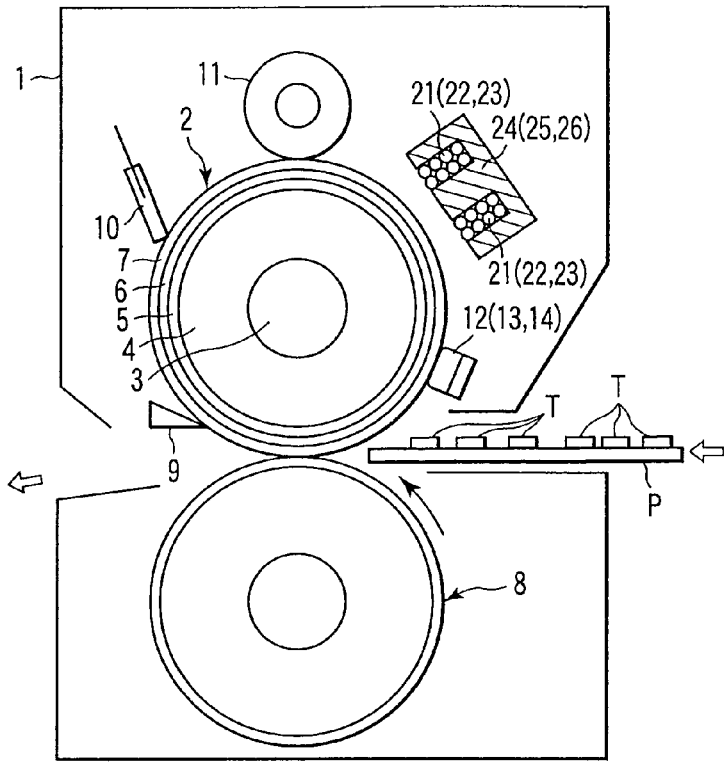
FIG. 1 is a diagram illustrating a fixing apparatus according to any embodiment of this invention.
Figure 2:
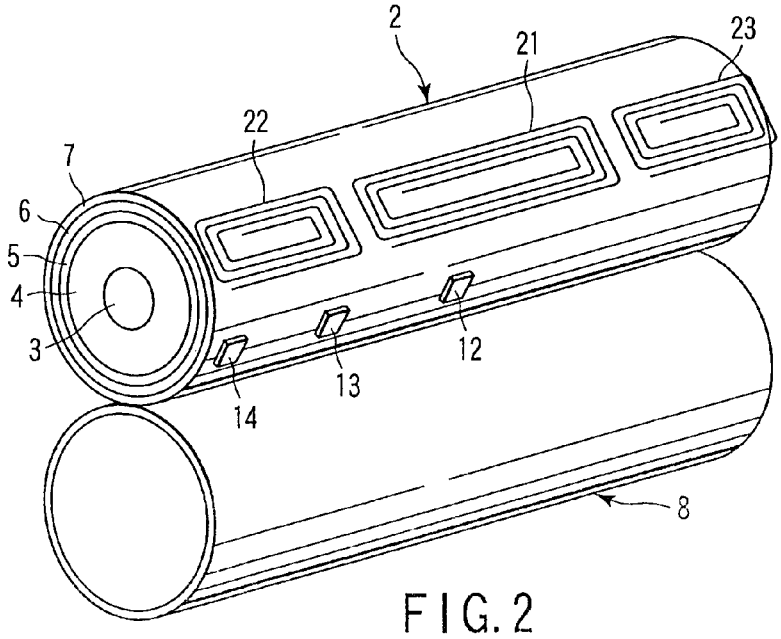
FIG. 2 is a diagram showing the configuration of the heat roller and coils of the fixing apparatus according to any embodiment.
Figure 3:
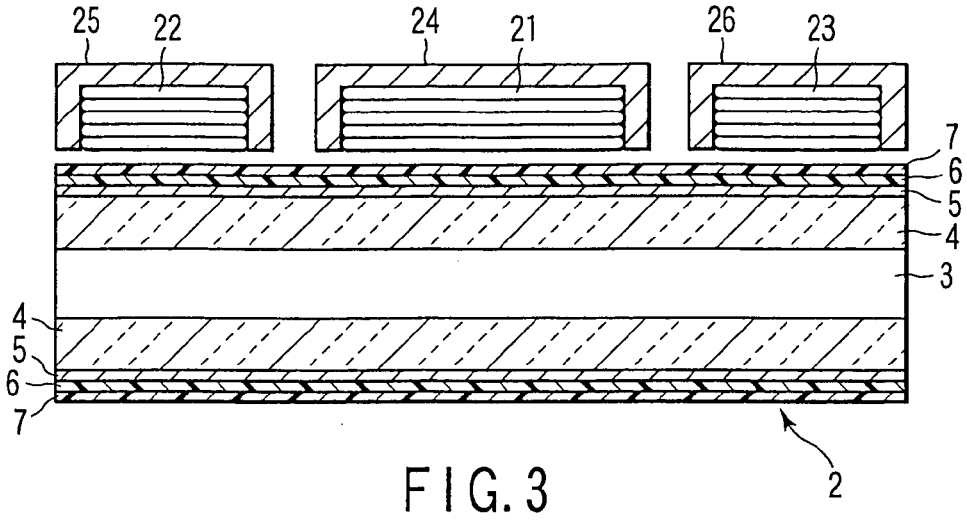
FIG. 3 is a diagram depicting the heat roller, coils and cores of the heat roller according to any embodiment.

The fixing apparatus has the configuration illustrated in FIGS. 1, 2 and 3.

The fixing apparatus 1 has a rotary heating member such as a heat roller 2. The heat roller 2 and also a press roller 8 (i.e., a pressing member) are located one upon the other, defining a sheet-transporting path between them. The press roller 8 contacts the surface (outer circumferential surface) of the heat roller 2. The press roller 8 rotates together with the heat roller 2 rotate together, taking a paper sheet P in the nip between it and the heat roller 2, and applies a pressure to the paper sheet P. Heat propagates from the heat roller 2 to the paper sheet P. The developer defining the developer image on the paper sheet P therefore melts. The developer image is thereby fixed on the paper sheet P.

The heat roller 2 has been made by forming a heat insulating layer 4, a metal layer 5, an elastic layer 6 and a surface layer 7 on a core 3, one upon another in the order they are mentioned. The heat roller 2 is rotated in the clockwise direction in FIG. 1.

Around the heat roller 2 there are arrange a claw 9, a cleaning member 10, an oil-applying roller 11, a center coil 21, side coils 22 and 23, a first temperature sensor 12, a second temperature sensor 13, and a third temperature sensor 14. The claw 9 is provided to peel the paper sheet P from the heat roller 2. The cleaning member 10 is designed to remove residual developer, paper dust and the like from the heat roller 2. The oil-applying roller 11 applies oil to the surface of the heat roller 2. The center coil 21 performs induction heating. The side coils 22 and 23 perform induction heating, too. The first to third temperature sensors 12, 13 and 14 detect the surface temperature of the heat roller 2.

The center coil 21 is located at that part of the heat roller 2 which is substantially middle in the direction (axial direction) at right angles to the direction in which the heat roller 2 rotates. The side coils 22 and 23 are positioned, respectively at one end part of the roller 2 and the other end thereof, as viewed in the direction at right angles to the direction in which the heat roller 2 rotates. The side coils 22 and 23 are connected to each other, forming a single coil in effect.

The coils 21, 22 and 23 are wound around cores 24, 25 and 26, respectively. They can generate high-frequency magnetic fields for use in induction heating. The high-frequency magnetic fields are applied to the metal layer 5 of the heat roller 2, generating eddy currents in the metal layer 5. The eddy currents bring forth Joule heat, which emanates from the metal layer 5.

The temperature sensor 12 detects the temperature T1 of that part of the heat roller 2 which is substantially middle in the direction at right angles to the direction in which the heat roller 2 rotates. The temperature sensor 13 detects the temperature T2 of one end part of the roller 2, as viewed in the direction at right angles to the direction in which the heat roller 2 rotates. The temperature sensor 14 detects the temperature of the end of said one end part of the roller 2, for the sake of safety.

The temperature sensors 12, 13 and 14 may be positioned in contact with the surface of the heat roller 2. Alternatively, they may be space apart from the heat roller 2.

Figure 4:
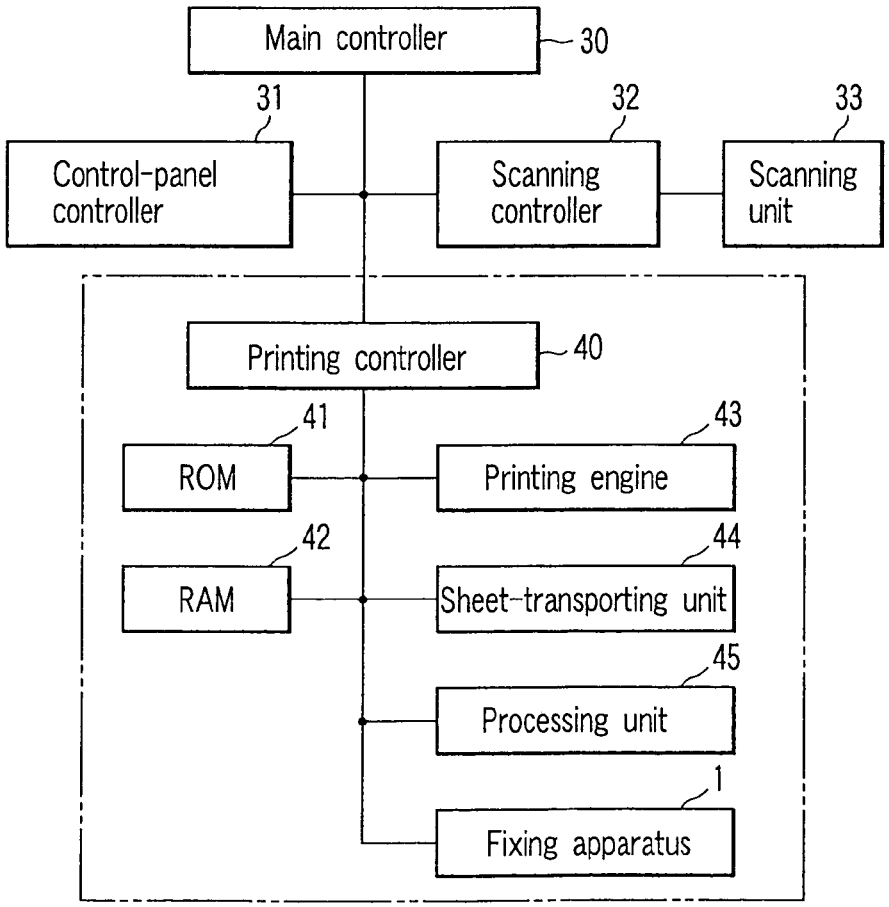
FIG. 4 is a block diagram representing the control circuit that is provided in an image forming apparatus according to any embodiment.

FIG. 4 shows the control circuit provided in the image forming apparatus described above.

In the control circuit, a control-panel controller 31, a scanning controller 32 and a printing controller 40 are connected to a main controller 30.

The maim controller 30 controls the control-panel controller 31, scanning controller 32 and printing controller 40. The scanning controller 32 controls the scanning unit 33 that optically reads the image printed on the original document.

To the printing controller 40 there are connected to a ROM 41, a RAM 42, a printing engine 43, a sheet-transporting unit 44, the processing unit 45, and the fixing unit 1. The ROM 41 stores control programs. The RAM 42 can store data. The printing engine 43 emits a laser beam to reproduce the image read by the scanning unit 33, on the surface of a photosensitive drum. The sheet-transporting unit 44 comprises a sheet-transporting mechanism and a drive circuit for driving the mechanism. Using the laser beam emitted from the printing engine 43, the processing unit 45 forms, on the surface of the photosensitive drum, an electrostatic latent image that corresponds to the image that the scanning unit 33 has read. The processing unit 45 then applies a developer to the photosensitive drum, changing the latent image to a developer image, and transfers developer image to the paper sheet P.

Figure 5:
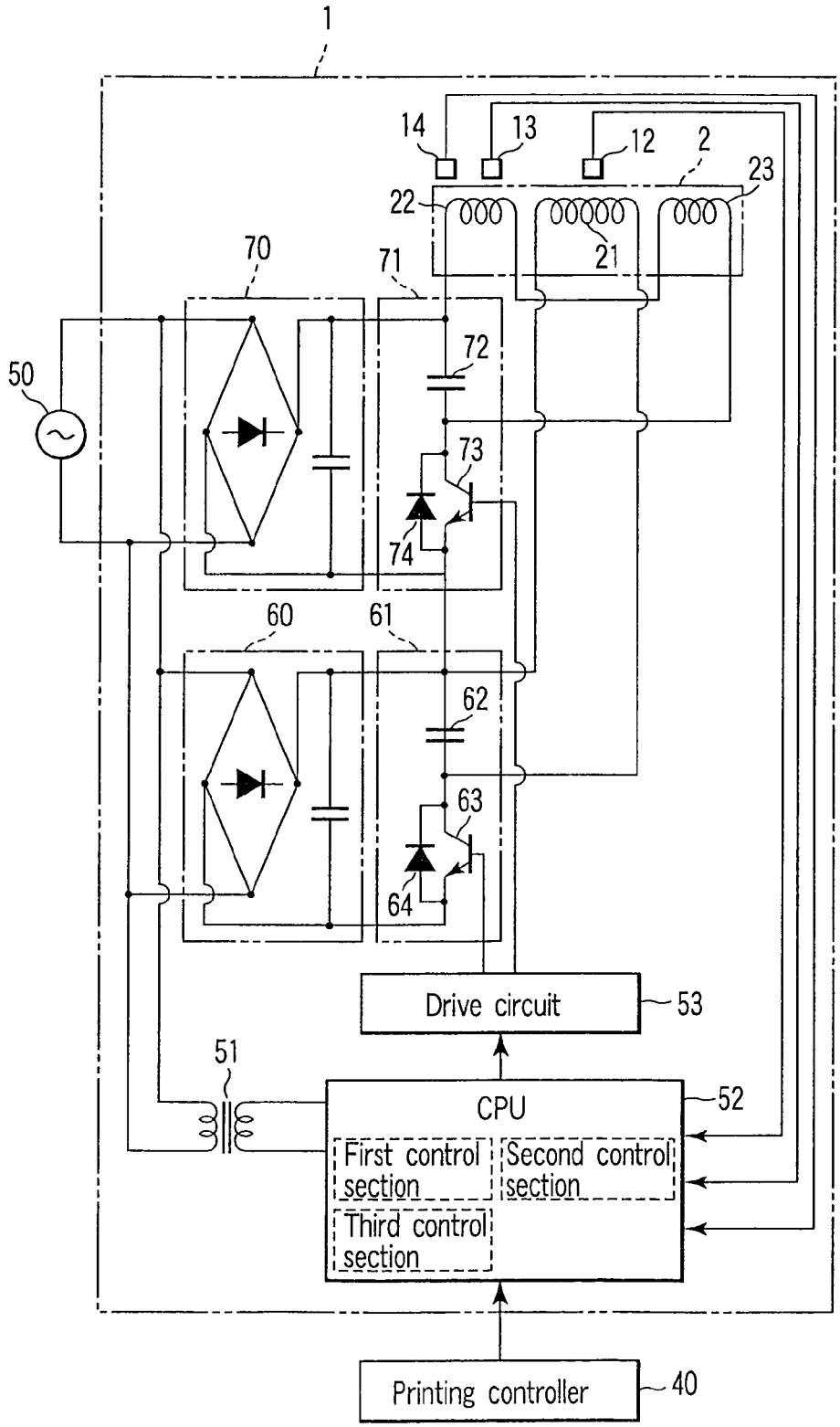
FIG. 5 is a block diagram showing the electric circuit provided in the fixing apparatus according to any embodiment.

FIG. 5 depicts the electric circuit incorporated in the fixing apparatus 1.

A CPU 52 is connected to the commercially available power supply 50 via a voltage-lowering transformer 51. Rectifying circuits 60 and 70 are connected to the commercially available power supply 50, too. High-frequency generating circuits (also called "switching circuits") 61 and 71 are connected to the outputs of the rectifying circuits 60 and 70, respectively.

The high-frequency generating circuit 61 comprises a resonant capacitor 62, a switching element such as a transistor 63, and a damper diode 64. The resonant capacitor 62 constitutes a resonant circuit, jointly with the center coil 21. The transistor 63 excites the resonant circuit. The damper diode 64 is connected in parallel to the transistor 63. The circuit 61 generates a high-frequency current as a drive circuit 53 repeatedly turns the transistor 63 on and off.

The high-frequency generating circuit 71 comprises a resonant capacitor 72, a switching element such as a transistor 73, and a damper diode 74. The resonant capacitor 72 constitutes a resonant circuit, jointly with the side coils 22 and 23. The transistor 73 excites the resonant circuit. The damper diode 64 is connected in parallel to the transistor 73. The circuit 71 generates a high-frequency current as a drive circuit 53 repeatedly turns the transistor 73 on and off.

The high-frequency current generated by the high-frequency generating circuit 61 is supplied to the center coil 21, and the high-frequency current generated by the high-frequency generating circuit 71 is supplied to the side coils 22 and 23. The center coil 21 and the side coils 22 and 23 generate high-frequency magnetic fields. The magnetic fields result in eddy currents in the metal layer 5 of the heat roller 2. The eddy currents bring forth Joule heat, which emanates from the metal layer 5.

The temperature sensors 12, 13 and 14, the printing controller 40 and the drive circuit 53 are connected to the CPU 52.

The CPU 52 has a first control section, a second control section, and a third control section, which operate with the voltage applied from the transformer 51. The first control section performs a warming-up operation process, driving the center coil 21 and the side coils 22 and 23 in the modes stored in the RAM 42, until the temperatures T1 and T2 detected by the sensors 12 and 13, respectively, reach the preset value Ts. The second control section finds the temperature rise ΔT1 of the temperature T1 per unit time t and the temperature rise ΔT2 of the temperature T2 per unit time t during the warming-up operation process. The third control section updates the operating mode of the coils 21, 22 and 23 stored in the RAM 42 so that the temperature rises ΔT1 and ΔT2 determined by the second control section may become equal to each other.

Figure 6:
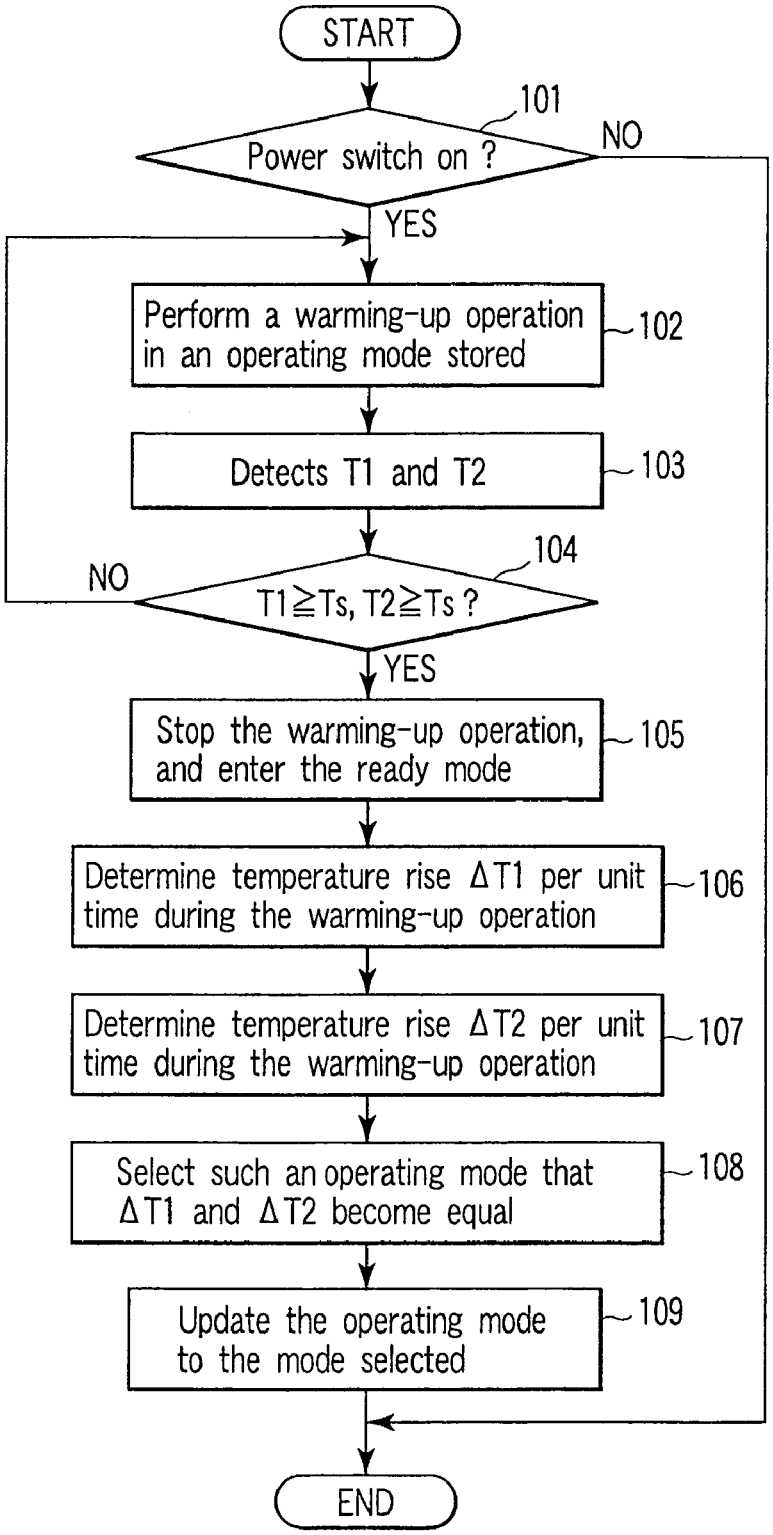
FIG. 6 is a flowchart explaining how the embodiment operates.

How the fixing apparatus operates will be described, with reference to the flowchart of FIG. 6.

When the commercially available power supply 50 is turned on (YES in Step 101), the center coil 21 and the side coils 22 and 23 are driven in an operating mode that is stored in the RAM 42, whereby the warming-up operation is carried out (Step 102). That is, the center coil 21 and the side coils 22 and 23 are alternately driven, each time for a time already stored in the RAM 42. The temperature sensor 12 detects the temperature T1 of the substantially middle part of the heat roller 2, and the temperature sensor 13 detects the temperature T2 of one end part of the heat roller 2 (Step 103). When both temperatures T1 and T2 reach the preset value Ts (YES in Step 104), the warming-up operation is terminated, and the image forming apparatus are set to the ready mode (Step 105).

Figures 7, 8, 9:
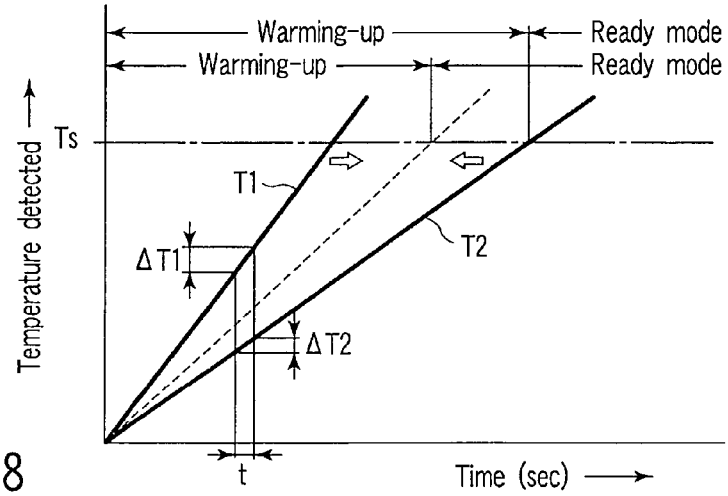
FIG. 7 is a table showing various modes in which the coils are driven in a first embodiment of the invention.
FIG. 8 is a graph illustrating how the temperatures T1 and T2 change in the embodiment.
FIG. 9 is a table showing various modes in which the coils are driven in a second embodiment of this invention.

At the end of the warming-up operation, the temperature rise ΔT1 of the temperature T1 per unit time t during the warming-up operation is determined (Step 106). The temperature rise ΔT2 of the temperature T2 per unit time t during the warming-up operation is determined (Step 107), too. Then, another operating mode in which the coils are driven to make the temperature rises ΔT1 and ΔT2 equal is selected from those stored in the ROM 41 (Step 108). FIG. 7 shows the various operating modes that are stored in the ROM 41.

In the standard mode "17" i.e., one of these operating modes, the center coil is driven for 1 second and the side coils 22 and 23 are driven for 1 second, too (drive-time ratio is 10:10). When the temperature rise ΔT1 is greater than the temperature rise ΔT2 as shown in FIG. 8, one of the operating modes "18" "19" "20" "21" and "22" is selected to increase the temperature rise ΔT2. In the operating mode "18" the center coil 21 is driven for 1 second and the side coils 22 and 23 are driven for 1.1 seconds (drive-time ratio is 10:11). In the operating mode "19" the center coil 21 is driven for 1 second and the side coils 22 and 23 are driven for 1.2 seconds (drive-time ratio is 10:12). In the operating mode "20" the center coil 21 is driven for 1 second and the side coils 22 and 23 are driven for 1.3 seconds (drive-time ratio is 10:13). In the operating mode "21" the center coil 21 is driven for 1 second and the side coils 22 and 23 are driven for 1.4 seconds (drive-time ratio is 10:14). In the operating mode "22" the center coil 21 is driven for 1 second and the side coils 22 and 23 are driven for 1.5 seconds (drive-time ratio is 10:15).

The operating mode selected in Step 108 is stored in the RAM 42, thus updating the operating mode for the coils (Step 109). The operating mode stored last remains even if the power switch is turned off and the coils 21, 22 and 23 will be driven in this mode to perform the warming-up operation when the power switch is turned on next time. In the warming-up operation that starts when the power switch is turned on, the temperature rise ΔT2 of the temperature T2 per unit time is increased until it becomes equal to the temperature rise ΔT1.

Thus, the temperature T2 detected rises fast, shortening the warming-up operation time. Since the warming-up operation time is shortened, the output of the center coil 21 can be saved in connection to the temperature T1 detected.

The temperature sensors 12 and 13 are located downstream of the coils 21, 22 and 23 with respect to the direction in which the heat roller rotates. The sensors 12 and 13 can therefore accurately detect the temperature of the heat roller 2 that is undergoing induction heating.

The temperature rise ΔT1 may be less than the temperature rise ΔT2. In this case, any one of the operating modes "16" "15" "14" "13" and "12"is selected to increase the temperature rise ΔT1. In the operating mode "16" the center coil 21 is driven for 1.1 seconds and the side coils 22 and 23 are driven for 1 second (drive-time ratio is 11:10). In the operating mode "15" the center coil 21 is driven for 1.2 seconds and the side coils 22 and 23 are driven for 1 second (drive-time ratio is 12:10). In the operating mode "14" the center coil 21 is driven for 1.3 seconds and the side coils 22 and 23 are driven for 1 second (drive-time ratio is 13:10). In the operating mode "13" the center coil 21 is driven for 1.4 seconds and the side coils 22 and 23 are driven for 1 second (drive-time ratio is 14:10). In the operating mode "12" the center coil 21 is driven for 1.5 seconds and the side coils 22 and 23 are driven for 1 second (drive-time ratio is 15:10).

[2] The second embodiment of this invention will be described.

FIG. 9 shows the various operating modes that are stored in the ROM 41.

In the standard mode "17" i.e., one of these operating modes, the center coil is driven for 1 second and the side coils 22 and 23 are driven for 1 second, too (drive-time ratio is 10:10). When the temperature rise ΔT1 is greater than the temperature rise ΔT2 as shown in FIG. 8, one of the operating modes "18" "19" "20" "21" and "22" is selected to increase the temperature rise ΔT2. In the operating mode "18" the center coil 21 is driven for 0.9 seconds and the side coils 22 and 23 are driven for 1.1 seconds (drive-time ratio is 9:11). In the operating mode "19" the center coil 21 is driven for 0.8 seconds and the side coils 22 and 23 are driven for 1.2 seconds (drive-time ratio is 8:12). In the operating mode "20" the center coil 21 is driven for 0.7 seconds and the side coils 22 and 23 are driven for 1.3 seconds (drive-time ratio is 7:13). In the operating mode "21" the center coil 21 is driven for 0.6 seconds and the side coils 22 and 23 are driven for 1.4 seconds (drive-time ratio is 6:14). In the operating mode "22" the center coil 21 is driven for 0.5 seconds and the side coils 22 and 23 are driven for 1.5 seconds (drive-time ratio is 10:15). The operating mode selected is stored in the RAM 42, thus updating the operating mode for the coils.

The temperature rise ΔT1 may be less than the temperature rise ΔT2. In this case, any one of the operating modes "16" "15" "14" "13" and "12" is selected. In the operating mode "16" the center coil 21 is driven for 1.1 seconds and the side coils 22 and 23 are driven for 0.9 seconds (drive-time ratio is 1.1:0.9). In the operating mode "15" the center coil 21 is driven for 1.2 seconds and the side coils 22 and 23 are driven for 0.8 seconds (drive-time ratio is 1.2:0.8). In the operating mode "14" the center coil 21 is driven for 1.3 seconds and the side coils 22 and 23 are driven for 0.7 seconds (drive-time ratio is 1.3:0.7). In the operating mode "13" the center coil 21 is driven for 1.4 seconds and the side coils 22 and 23 are driven for 0.6 seconds (drive-time ratio is 1.4:0.6). In the operating mode "12" the center coil 21 is driven for 1.5 seconds and the side coils 22 and 23 are driven for 0.5 seconds (drive-time ratio is 1.5:0.5). The operating mode selected is stored in the RAM 42, thus updating the operation mode for the coils.

The second embodiment is identical to the first embodiment in other structural features, operation and advantages. Its other structural features, its operation or its advantage will not described.

[3] The third embodiment of this invention will be described.

In this embodiment, the center coil 21 and the side coils 22 and 23 are driven at the same time, generating different amounts of output that are stored already, thus performing the warming-up operation. No limits are imposed on the sum of their outputs.

At the end of the warming-up operation, the temperature rise ΔT1 of the temperature T1 per unit time t during the warming-up operation is determined. The temperature rise ΔT2 of the temperature T2 per unit time t during the warming-up operation is determined, too. Then, an operating mode in which the coils are driven to make the temperature rises ΔT1 and ΔT2 equal is selected from those stored in the ROM 41. FIG. 10 shows the various operating modes that are stored in the ROM 41.

In the standard mode "11" the output of the center coil 21 is 1000 W, and the output of the side coils 22 and 23 is 1000 W, too (namely, the ratio is 1000:1000). If the temperature rise ΔT1 is greater than the temperature rise ΔT2 as shown in FIG. 8, one of operating modes "12" to "21" is selected to increase the temperature rise ΔT2. In the operating mode "12" the output of the center coil 21 is 1000 W and the output of the side coils 22 and 23 is 1020 W (the ratio is 1000:1020). In the operating mode "13" the output of the center coil 21 is 1000 W and the output of the side coils 22 and 23 is 1040 W (the ratio is 1000:1040). In the operating mode "21" the output of the center coil 21 is 1000 W and the output of the side coils 22 and 23 is 1200 W (the ratio is 1000:1200).

The operating mode selected is stored in the RAM 42, updating the mode stored therein. The operating mode, thus updated, is held in the RAM 42 and will be used when the power switch is turned on next time. In the next warming-up operation, the temperature rise ΔT2 per unit t increases, becoming equal to the temperature rise ΔT1. That is, ΔT1=ΔT2.

Thus, the temperature T2 detected rises at an increased rate. Therefore, the time required to accomplish the warming-up operation can be shortened. As for the temperature T1 detected, the power wasted by the center coil 21 can be decreased, because the time for the warming-up operation is shortened.

The temperature rise ΔT1 may be less than the temperature rise ΔT2. If this is the case, one of the operating modes "10" to "1" is selected increase the temperature rise ΔT1. In the operating mode "10" the output of the center coil 21 is 1020 W and the output of the side coils 22 and 23 is 1000 W (the ratio is 1030:1000). In the operating mode "9" the output of the center coil 21 is 1040 W and the output of the side coils 22 and 23 is 1000 W (the ratio is 1040:1000). The description of the operating modes "8" to "2" is omitted. In the operating mode "1" the output of the center coil 21 is 1200 W and the output of the side coils 22 and 23 is 1000 W (the ratio is 1200:1000).

The third embodiment is identical to the first embodiment in other structural features, operation and advantages. Its other structural features, its operation or its advantage will not described.

[4] The fourth embodiment of the invention will be described.

In this embodiment, the center coil 21 and the side coils 22 and 23 are driven at the same time, generating different amounts of output that are stored already, thus performing the warming-up operation. The sum of their outputs is limited to 2000 W.

At the end of the warming-up operation, the temperature rise ΔT1 of the temperature T1 per unit time t during the warming-up operation is determined. The temperature rise ΔT2 of the temperature T2 per unit time t during the warming-up operation is determined, too. Then, an operating mode in which the coils are driven to make the temperature rises ΔT1 and ΔT2 equal is selected from those stored in the ROM 41. FIG. 11 shows the various operating modes that are stored in the ROM 41.

In the standard mode "11" the output of the center coil 21 is 1000 W, and the output of the side coils 22 and 23 is 1000 W, too (namely, the ratio is 1000:1000). If the temperature rise ΔT1 is greater than the temperature rise ΔT2 as shown in FIG. 8, one of operating modes "12" to "21" is selected. In the operating mode "12" the output of the center coil 21 is 1020 W and the output of the side coils 22 and 23 is 800 W (the ratio is 1020:800). In the operating mode "13" the output of the center coil 21 is 1040 W and the output of the side coils 22 and 23 is 820 W (the ratio is 1040:820). The description of the operating modes "14" to "20" is omitted. In the operating mode "21" the output of the center coil 21 is 1200 W and the output of the side coils 22 and 23 is 980 W (the ratio is 1200:980). The operating mode, thus updated, is held in the RAM 42.

The temperature rise ΔT1 may be less than the temperature rise ΔT2. If this is the case, one of the operating modes "10" to "1" is selected increase the temperature rise ΔT1. In the operating mode "10" the output of the center coil 21 is 980 W and the output of the side coils 22 and 23 is 1020 W (the ratio is 900:1020). In the operating mode "9" the output of the center coil 21 is 960 W and the output of the side coils 22 and 23 is 1040 W (the ratio is 960:1040). In the operating mode "1" the output of the center coil 21 is 800 W and the output of the side coils 22 and 23 is 1200 W (the ratio is 800:1200). The operating mode, thus updated, is held in the RAM 42.

The fourth embodiment is identical to the first embodiment in other structural features, operation and advantages. Its other structural features, its operation or its advantage will not described.

Additional advantages and modifications will readily occur to those skilled in the art. Therefore, the invention in its broader aspects is not limited to the specific details and representative embodiments shown and described herein. Accordingly various modifications may be made without departing from the spirit or scope of the general inventive concept as defined by the appended claims and their equivalents.

What is claimed is:

1. A fixing apparatus comprising:

a heating member which rotates;

a first coil which is configured to perform induction heating on a middle of the heating member;

a second coil which is configured to perform induction heating on an end of the heating member;

a first temperature sensor located at the middle of the heating member;

a second temperature sensor located at the heating member;

a first control section which performs a warming-up operation by driving the first coil and the second coil;

a second control section which determines a temperature rise rate per unit time of the temperature detected by the first temperature sensor during the warming-up operation and also a temperature rise rate per unit time of the temperature detected by the second temperature sensor during the warming-up operation; and a third control section which controls the temperature rise rates to become equal to each other.

2. The apparatus according to claim 1, wherein the first control section performs a warming-up operation in which the first coil and the second coil are alternately driven until the temperatures detected by the first and second temperature sensors, respectively, reach a preset value; and the third control section updates a ratio between a period of driving the first coil and a period of driving the second coil to such a value that the temperature rises determined by the second control section become equal to each other.

3. The apparatus according to claim 1, wherein the first control section performs a warming-up operation in which the first coil and the second coil are simultaneously driven until the temperatures detected by the first and second temperature sensors, respectively, reach a preset value, and the third control section updates a ratio between a period of driving the first coil and a period of driving the second coil to such a value that the temperature rises determined by the second control section become equal to each other.

4. The apparatus according to claim 1, further comprising:

a first high-frequency generating circuit which outputs a high-frequency current that causes the first coil to generate a high-frequency magnetic field for achieving induction heating; and a second high-frequency generating circuit which outputs a high-frequency current that causes the second coil to generate a high-frequency magnetic field for achieving induction heating.

5. The apparatus according to claim 1, further comprising:

a pressure-applying member which contacts the heating member, rotates as the heating member rotates and applies a pressure to an object held between the heating member and the pressure-applying member.

6. The apparatus according to claim 1, wherein the first temperature sensor and the second temperature sensor are located downstream of the first and second coils, respectively, with respect to the direction in which the heating member rotates.

7. A fixing apparatus comprising:

a heat roller which rotates;

a first coil which is configured to perform induction heating on a middle of the heat roller;

a second coil which is configured to perform induction heating on an end of the heat roller;

a first temperature sensor located at the middle of the heat roller;

a second temperature sensor located on the heat roller;

a first control section which performs a warming-up operation by driving the first coil and the second coil;

a second control section which determines a temperature rise rate per unit time of the temperature detected by the first temperature sensor during the warming-up operation and also a temperature rise rate per unit time of the temperature detected by the second temperature sensor during the warming-up operation; and a third control section which controls the temperature rise rates to become equal to each other.

8. The apparatus according to claim 7, wherein the first control section performs a warming-up operation in which the first coil and the second coil are alternately driven until the temperatures detected by the second temperature sensors, respectively, reach a preset value; and the third control section updates a ratio between a period of driving the first coil and a period of driving the second coil to such a value that the temperature rises determined by the second control section become equal to each other.

9. The apparatus according to claim 7, wherein the first control section performs a warming-up operation in which the first coil and the second coil are simultaneously driven until the temperatures detected by the first and second temperature sensors, respectively, reach a preset value; and the third control section updates a ratio between a period of driving the first coil and a period of driving the second coil to such a value that the temperature rises determined by the second control section become equal to each other.

10. The apparatus according to claim 7, further comprising:

a first high-frequency current generating circuit which outputs a high-frequency current that causes the first coil to generate a high-frequency magnetic field for achieving induction heating; and a second high-frequency current generating circuit which outputs a high-frequency current that causes the second coil to generate a high-frequency magnetic field for achieving induction heating.

11. The apparatus according to claim 7, further comprising;

a press roller which contacts the heat roller, rotates as the heat roller rotates and applies a pressure to an object held between the heat roller and the press roller.

12. The apparatus according to claim 7, wherein the first temperature sensor and the second temperature sensor are located downstream of the first and second coils, respectively, with respect to the direction in which the heat roller rotates.

13. An image forming apparatus comprising:

a reading unit which reads an image from an original document;

a processing unit which forms the image read by the reading unit, on a paper sheet used as an image forming medium; and a fixing apparatus which fixes the image on the paper sheet by heating the paper sheet, the fixing apparatus comprising:

a heating member which rotates;

a first coil which is configured to perform induction heating on a middle of the heating member;

a second coil which is configured to perform induction heating on an end of the heating member;

a first temperature sensor located at the middle of the heating member;

a second temperature sensor located on the heating member;

a first control section which performs a warming-up operation by driving the first coil and the second coil;

a second control section which determines a temperature rise rate per unit time of the temperature detected by the first temperature sensor during the warming-up operation and also a temperature rise rate per unit time of the temperature detected by the second temperature sensor during the warming-up operation; and a third control section which controls the temperature rise rates to become equal to each other.

14. The apparatus according to claim 13, wherein the first control section performs a warming-up operation in which the first coil and the second coil are alternately driven until the temperatures detected by the first and second temperature sensors, respectively, reach a preset value; and the third control section updates a ratio between a period of driving the first coil and a period of driving the second coil to such a value that the temperature rises determined by the second control section become equal to each other.

15. The apparatus according to claim 13, wherein the first control section performs a warming-up operation in which the first coil and the second coil are simultaneously driven until the temperatures detected by the first and second temperature sensors, respectively, reach a preset value; and the third control section updates a ratio between a period of driving the first coil and a period of driving the second coil to such a value that the temperature rises determined by the second control section become equal to each other.

16. The apparatus according to claim 13, further comprising:

a first high-frequency generating circuit which outputs a high-frequency current that causes the first coil to generate a high-frequency magnetic field for achieving induction heating; and a second high-frequency generating circuit which outputs a high-frequency current that causes the second coil to generate a high-frequency magnetic field for achieving induction heating.

17. The apparatus according to claim 13, further comprising:

a pressure-applying member which contacts the heating member, rotates as the heating member rotates and applies a pressure to an object held between the heating member and the pressure-applying member.

18. The apparatus according to claim 13, wherein the first temperature sensor and the second temperature sensor are located downstream of the first and second coils, respectively, with respect to the direction in which the heating member rotates.

* * * * *